US010323891B1

(12) United States Patent
Zheng

(10) Patent No.: US 10,323,891 B1
(45) Date of Patent: Jun. 18, 2019

(54) EXTREMELY SHORT BUFFER SYSTEM AND BOLT CARRIER DESIGN FOR FIREARMS

(71) Applicant: Jing Zheng, El Paso, TX (US)

(72) Inventor: Jing Zheng, El Paso, TX (US)

( * ) Notice: Subject to any disclaimer, the term of this patent is extended or adjusted under 35 U.S.C. 154(b) by 0 days.

(21) Appl. No.: 16/041,759

(22) Filed: Jul. 21, 2018

(51) Int. Cl.

| | |
|---|---|
| ***F41A 3/84*** | (2006.01) |
| ***F41A 3/88*** | (2006.01) |
| ***F41C 23/04*** | (2006.01) |
| *F41A 5/18* | (2006.01) |

(52) U.S. Cl.
CPC *F41A 3/88* (2013.01); *F41A 3/84* (2013.01); *F41C 23/04* (2013.01); *F41A 5/18* (2013.01)

(58) Field of Classification Search
CPC ..... F41A 3/78; F41A 3/80; F41A 3/82; F41A 3/84
USPC ..... 42/1.06; 89/198
See application file for complete search history.

(56) References Cited

U.S. PATENT DOCUMENTS

| | | | | |
|---|---|---|---|---|
| 8,418,389 | B1 * | 4/2013 | Lukman | F41A 5/10 42/1.06 |
| 8,955,422 | B1 * | 2/2015 | Schumacher | F41A 3/12 42/72 |
| 9,322,604 | B2 * | 4/2016 | Neitzling | F41A 3/26 |
| 2018/0224227 | A1 * | 8/2018 | Durham, III | F41A 3/26 |

* cited by examiner

*Primary Examiner* — Reginald S Tillman, Jr.
(74) *Attorney, Agent, or Firm* — Han IP PLLC; Andy M. Han

(57) ABSTRACT

A device implementable in an AR-15 styled firearm includes a buffer tube and spring system and a bolt carrier assembly. The buffer tube and spring system is mounted on a lower receiver of the firearm and includes a pusher and a buffer tube which has a cavity that receives the pusher and the bolt carrier tail therein. The bolt carrier assembly includes a bolt carrier head and a bolt carrier tail connected to the pusher. The bolt carrier head includes a cavity that houses a bolt assembly of the firearm therein. The bolt carrier tail is elastically coupled to the bolt carrier head such that the bolt carrier head travels linearly at most by a first dimension, the bolt carrier tail travels linearly at most by a second dimension smaller than the first dimension, and the buffer travels linearly at most by a third dimension smaller than the second dimension.

20 Claims, 16 Drawing Sheets

EXTREMELY SHORT BUFFER SYSTEM AND BOLT CARRIER DESIGN FOR FIREARMS

TECHNICAL FIELD

The present disclosure generally relates to firearms. More specifically, the present disclosure relates to an extremely short buffer system and bolt carrier design for firearms.

BACKGROUND

A bolt carrier group (BCG) 100 of a traditional AR15-type firearm, as shown in FIG. 13, usually consists of a bolt carrier 103, a bolt assembly 101, a firing pin 105, a cam pin 102, and a firing pin retaining pin 104. For a direct impingement type of gas system to operate, hot gas directed from a gas tube (not shown) of a firearm would flow into the bolt carrier 103 through a gas channel 106 on the bolt carrier 103 and into the chamber (not shown) inside the bolt carrier 103 and push the bolt assembly 101 to rotate under a force generated by the cam pin 102. The hot gas typically has a mild pressure compared to the pressure in the gun barrel chamber; however, it is still considered as high pressure compared to ambient air pressure. A length 107 is the dimension between a front face of the bolt carrier 103 and a full auto actuation surface 108 on a rear face of the bolt carrier 103.

Referring to FIG. 14-FIG. 16, a lower assembly of a traditional AR15 firearm consists of a lower receiver 201, a buffer 202, a main spring 203, an end plate 204, a castle nut 205, a buffer tube 206, and a stock 207. The buffer tube 206 houses the buffer 202 and main spring 203 therein, while the castle nut 205 fastens the end plate 204 and the buffer tube 206 to the lower receiver 201. Once the firearm fires one cartridge, the BCG would retract back toward the back of the firearm and compress the main spring 203. A tail portion of the bolt carrier 103 would sink into or otherwise be received in the buffer tube 206. The stock 207 is attached to the buffer tube 206 though its own latching mechanism (not shown), such that the stock 207 can slide forward and backward as well as fasten to the buffer tube 206 at various points on the buffer tube 206, so that adjustment can be made to satisfy a specific length of arms of a user to allow the user to operate the firearm comfortably.

Current designs of AR15 firearms demand a buffer tube in various lengths greater than 7 to 8 inches in order for the direct impingement type of gas system to function properly. As such, the buffer tube 206, and the stock that 207 that is attached to it, cannot be folded to one side of the firearm to shorten the weapon system for carrying by a user in various compact situations, some of which would demand the weapon to be packed as short as possible.

Presently there are some folding stock adaptor designs that can fold the buffer tube and stock of a firearm with a direct impingement type of gas system. However, with such designs, when the buffer tube/stock is folded it is not safe to fire the firearm, thereby rendering the firearm useless after firing a first round of cartridge. In order for such designs to function, the buffer tube/stock needs to be unfolded to be in a combat configuration for the system to operate properly.

There exist other designs for shortening the buffer tube and the bolt carrier. However, those designs tend to render disassembly of the firearm difficult.

SUMMARY

The present disclosure proposes a novel design of an extremely short buffer system and bolt carrier design for firearms that addresses aforementioned issued with existing designs.

In one aspect, a device implementable in an AR-15 styled firearm may include a buffer tube and spring system and a bolt carrier assembly. The buffer tube and spring system may be configured to be mounted on a rear end of a lower receiver of the firearm. The buffer tube and spring system may include a pusher and a buffer tube. The buffer tube may include a cavity configured to receive the buffer therein. The bolt carrier assembly may include a bolt carrier head and a bolt carrier tail. A rear end of the bolt carrier tail may be connected to the pusher. A front end of the bolt carrier head may include a cavity configured to house a bolt assembly of the firearm therein. A front end of the bolt carrier tail may be elastically coupled to a rear end of the bolt carrier head such that, during operation of the firearm: (1) the bolt carrier head travels linearly at most by a first dimension, (2) the bolt carrier tail travels linearly at most by a second dimension smaller than the first dimension, and (3) the pusher travels linearly at most by a third dimension smaller than the second dimension.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Figure 1:
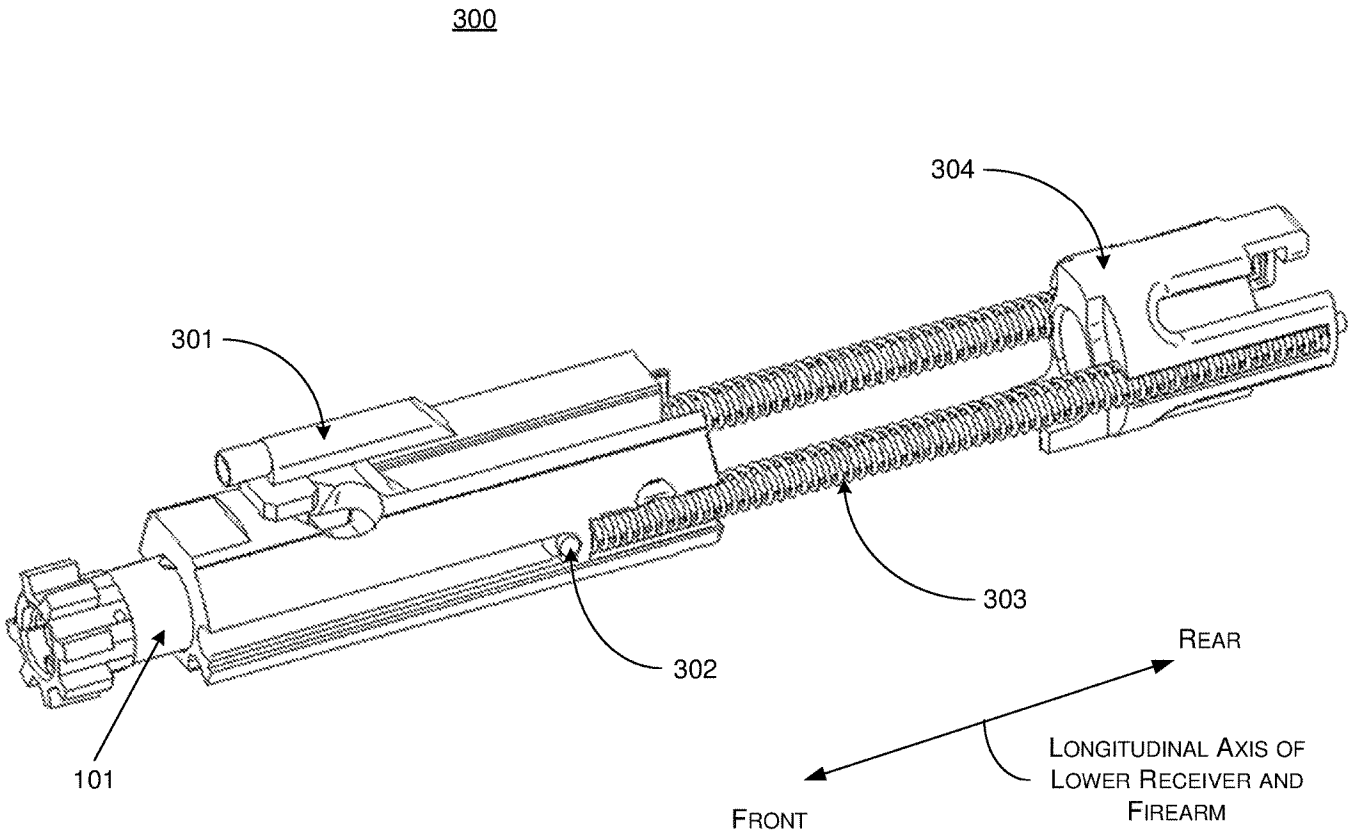
FIG. 1 is a diagram of a bolt carrier assembly in accordance with an embodiment of the present disclosure.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Overview

Figure 13:
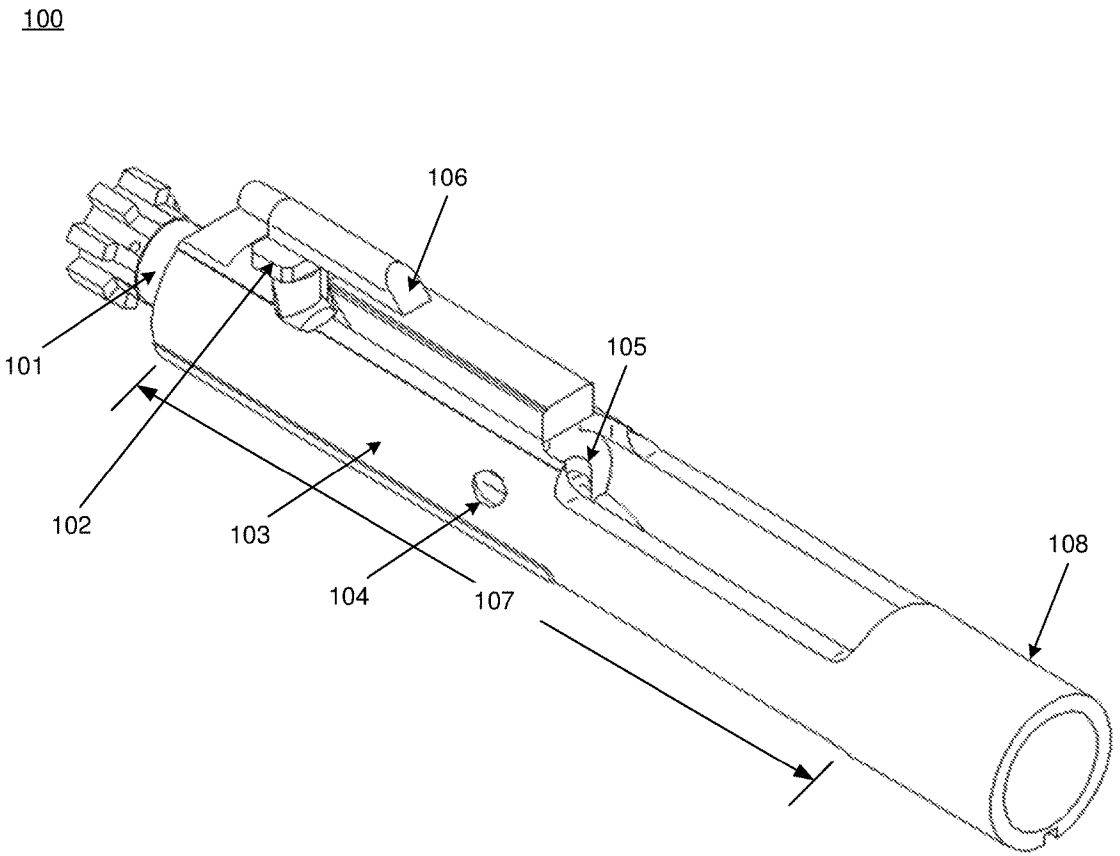
FIG. 13 (PRIOR ART)
FIG. 13 is a diagram of a conventional BCG of an AR15 firearm.
Figure 14:
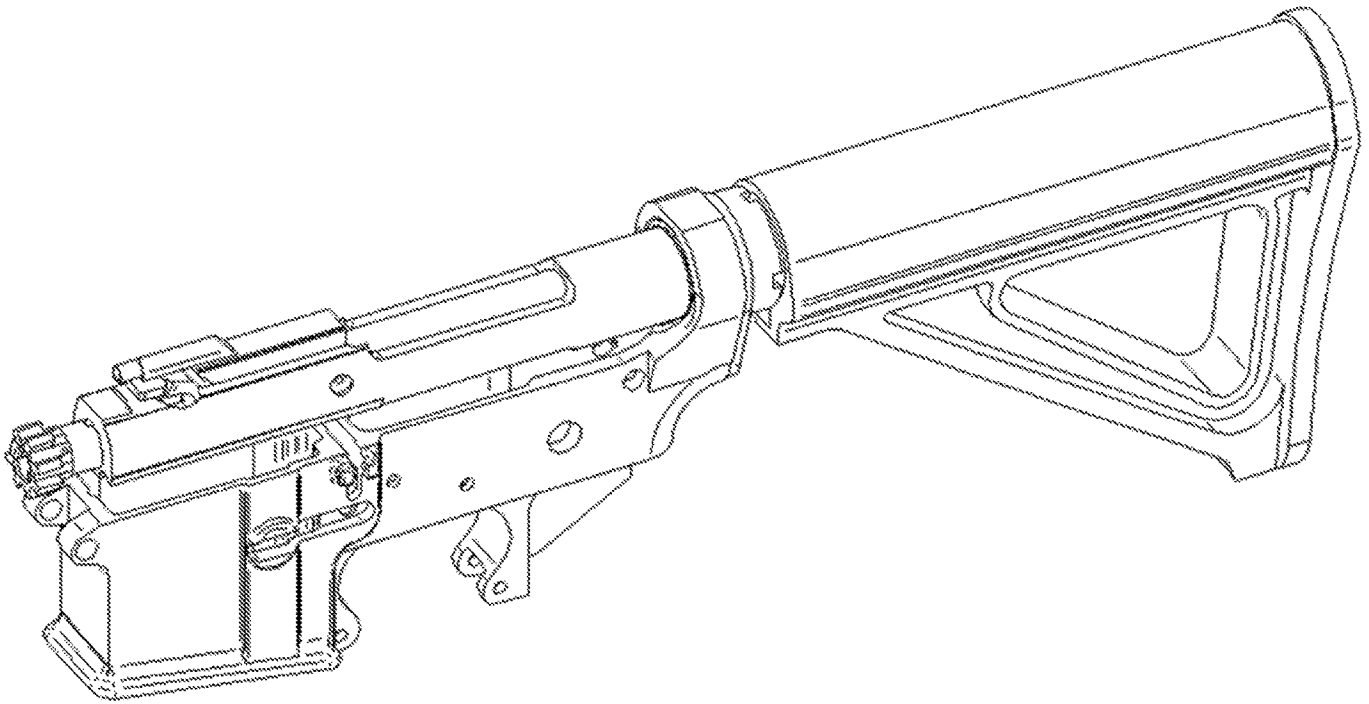
FIG. 14 (PRIOR ART)
FIG. 14 is a diagram of a conventional BCG in a battery position in relation to an AR15 lower assembly.
Figure 15:
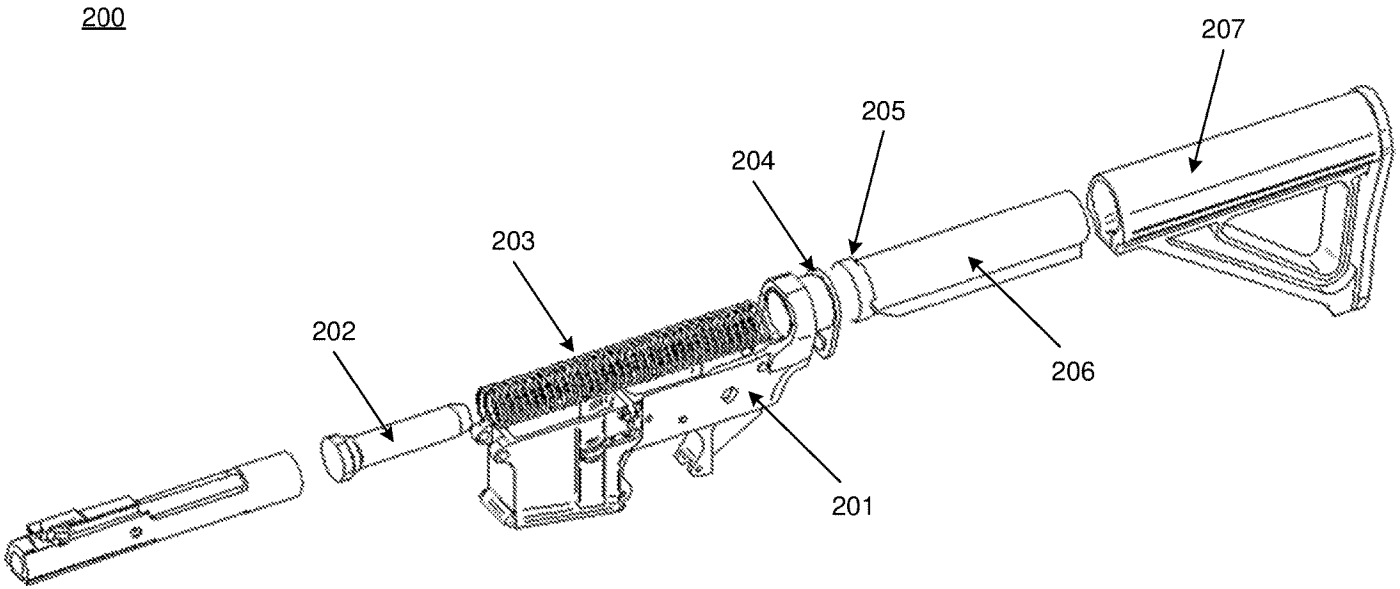
FIG. 15 (PRIOR ART)
FIG. 15 is a diagram of an exploded view of a conventional AR15 bolt carrier with a lower assembly.
Figure 16:
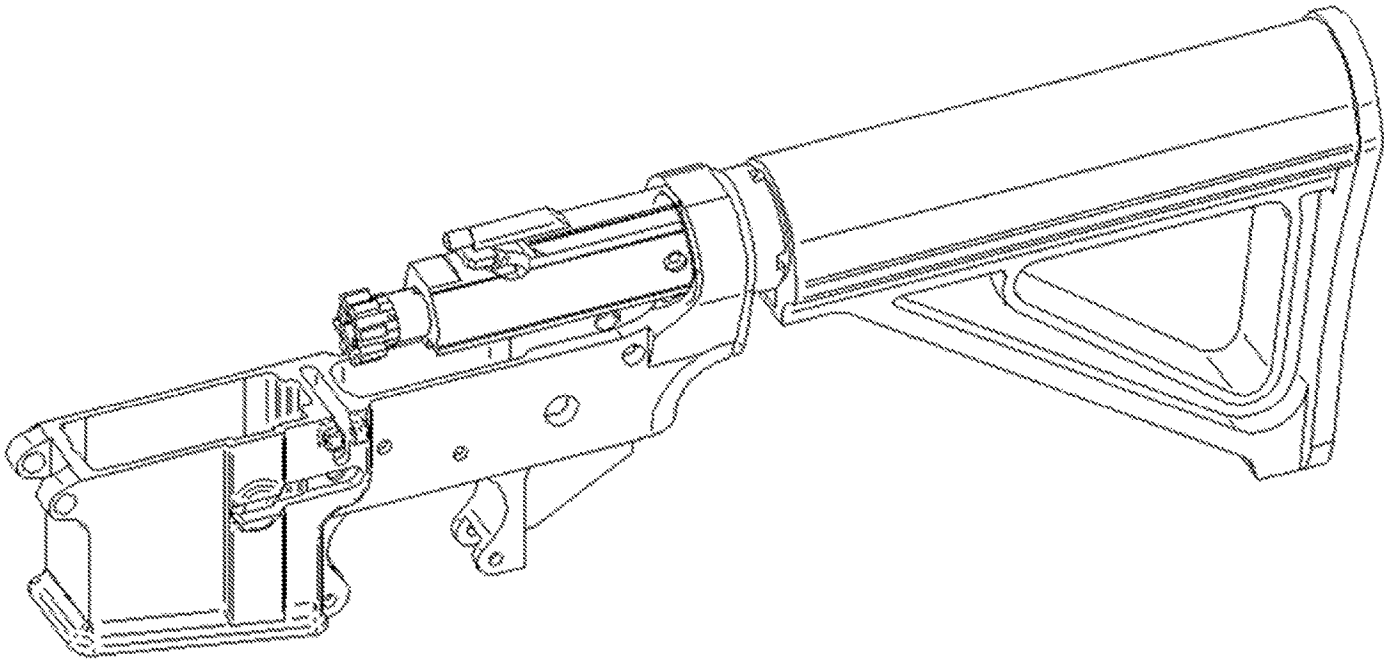
FIG. 16 (PRIOR ART)
FIG. 16 is a diagram of a conventional BCG in a retracted position when traveling backwards to a rear-most position in relation to an AR15 lower assembly.

FIG. 1 illustrates a bolt carrier assembly 300 in accordance with an embodiment of the present disclosure. Referring to FIG. 1, bolt carrier assembly 300 includes a bolt carrier head 301, two bolt carrier spring guide rods 302, two bolt carrier/main springs 303, and a buffer tail or bolt carrier tail 304. On one hand, bolt carrier head 301 retains major design features of bolt carrier 103, especially the front portion thereof. For instance, a front end of bolt carrier head 301 includes a cylindrical cavity configured to house bolt assembly 101 therein. On the other hand, compared to bolt carrier 103, bolt carrier head 301 is shortened almost all the way to the housing of firing pin 105 is located on bolt carrier 103, where the pointer of firing pin 105 is pointing in FIG. 13.

Figure 2:
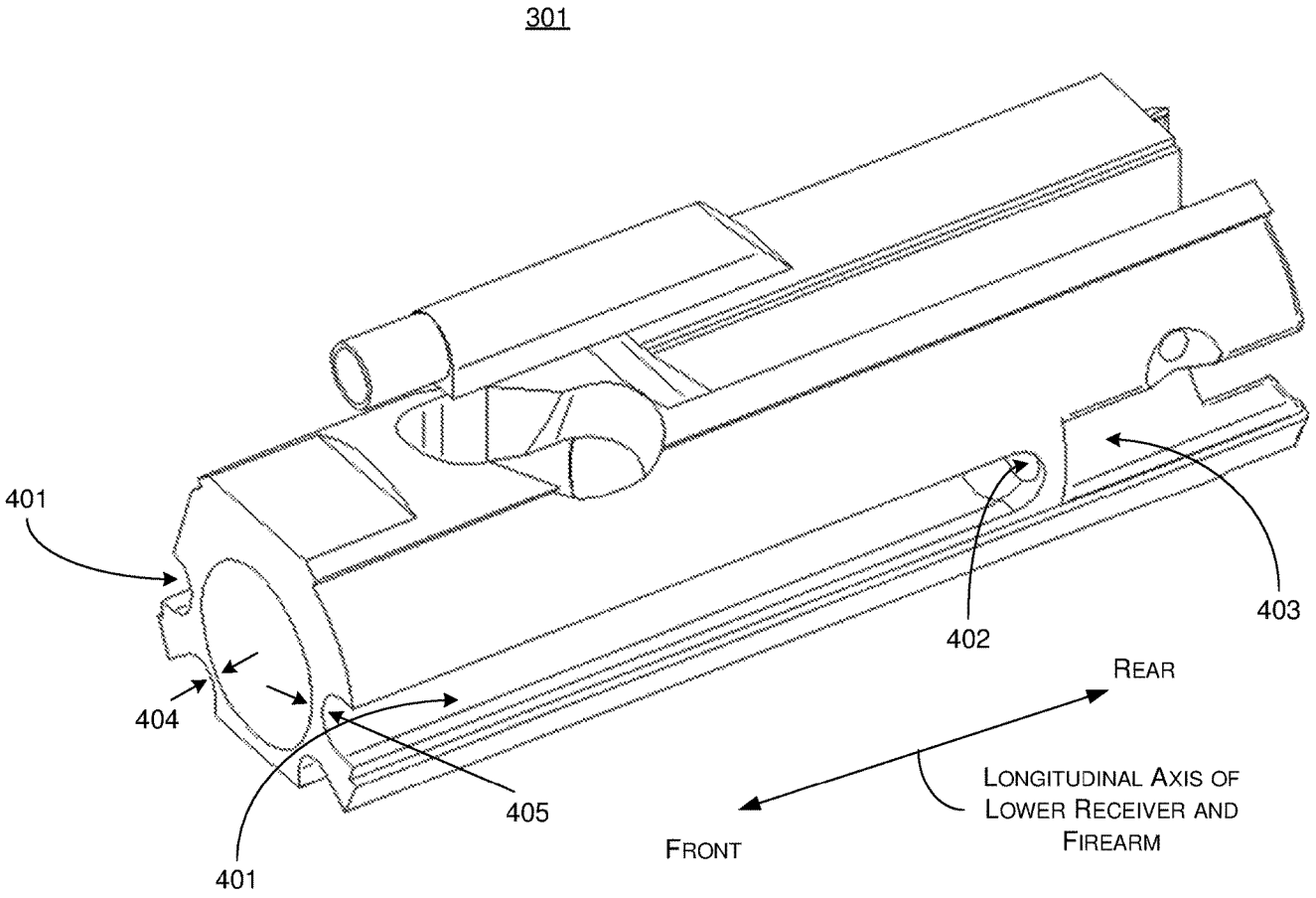
FIG. 2 is a diagram of a first view of a bolt carrier head in accordance with an embodiment of the present disclosure.
Figure 3:
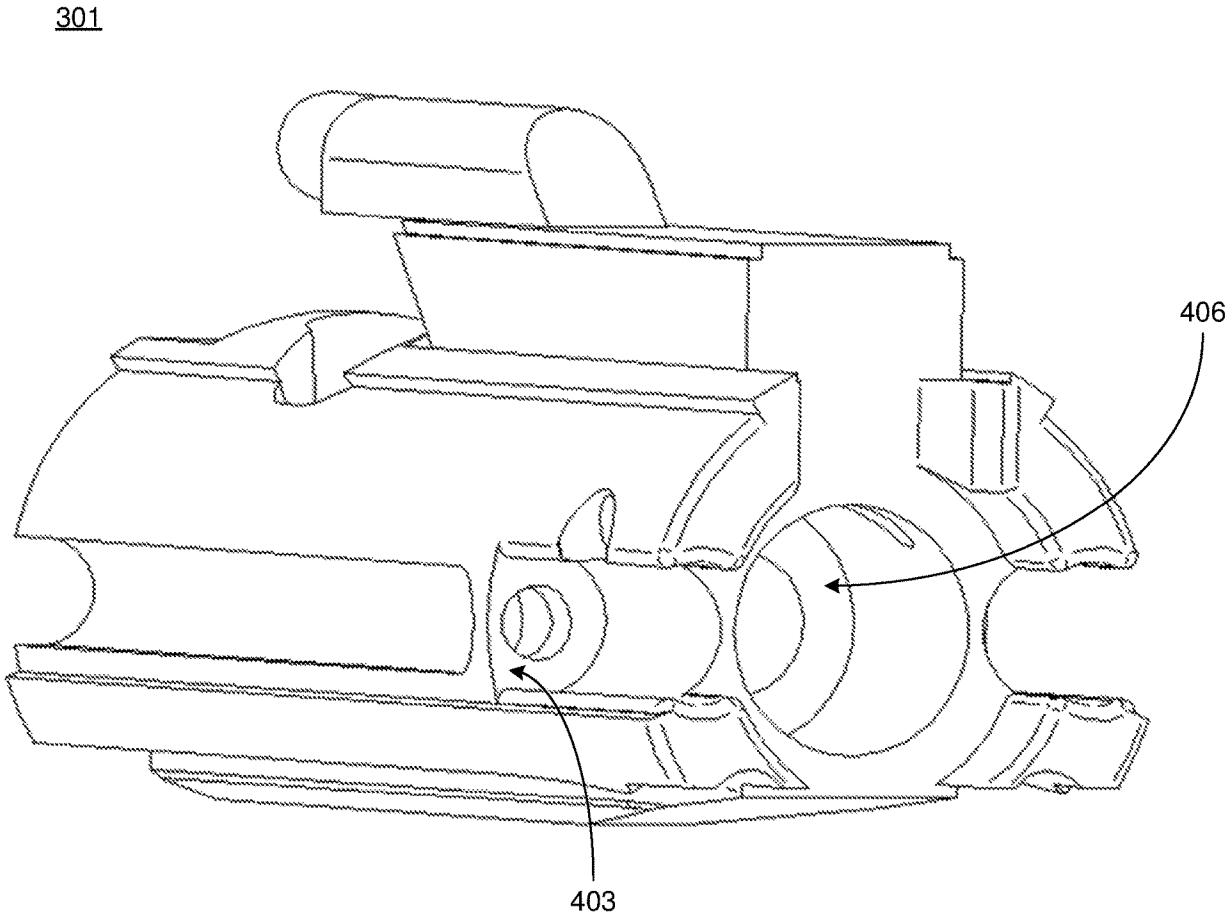
FIG. 3 is a diagram of a second view of the bolt carrier head of FIG. 2.

FIG. 2 and FIG. 3 each illustrates a respective view of bolt carrier head 301. Referring to FIG. 2, bolt carrier head 301 includes two clearance grooves 401 at the front-most portion of bolt carrier head 301. Bolt carrier head 301 also includes two clearance grooves 403 on two opposite sides of a rear portion of bolt carrier head 301. Each of the two clearance grooves 403 is configured to receive or otherwise accommodate one distal end of a respective one of the two bolt carrier/main springs 303. Bolt carrier head 301 further includes two guide rod clearance holes 402 on two opposite sides of bolt carrier head 301 and between clearance grooves 401 and clearance grooves 403. Each of the two bolt carrier spring guide rods 302 can slide freely within a respective one of the clearance grooves 401, clearance grooves 403 and guide rod clearance holes 402. The two bolt carrier spring guide rods 302 provide guidance for bolt carrier/main springs 303 to compress and extend during operation (e.g., during the cycling of bolt carrier head 301).

It is noteworthy that a magazine relief cut area 404 on bolt carrier head 301 is the thinnest area on bolt carrier head 301. With respect to the wall thickness at each of the clearance grooves 401, it is imperative to design the wall thickness 405 to be no less than that of magazine relief cut area 404. In some implementations, wall thickness 405 is thicker or greater than that of magazine relief cut area 404 by at least 0.014 inch.

Referring to FIG. 3, each of the two clearance grooves 403 has a surface that is on the same plane as that of a bottom plane of a firing pin housing pocket 406 on bolt carrier head 301, which is the surface of a pressure chamber within bolt carrier head 301 subject to the internal pressure from explosion of a round of ammunition. Accordingly, new design features on bolt carrier head 301 would not undermine the strength and structural integrity of the wall of the pressure chamber in the direction perpendicular to the surface.

Figure 4:
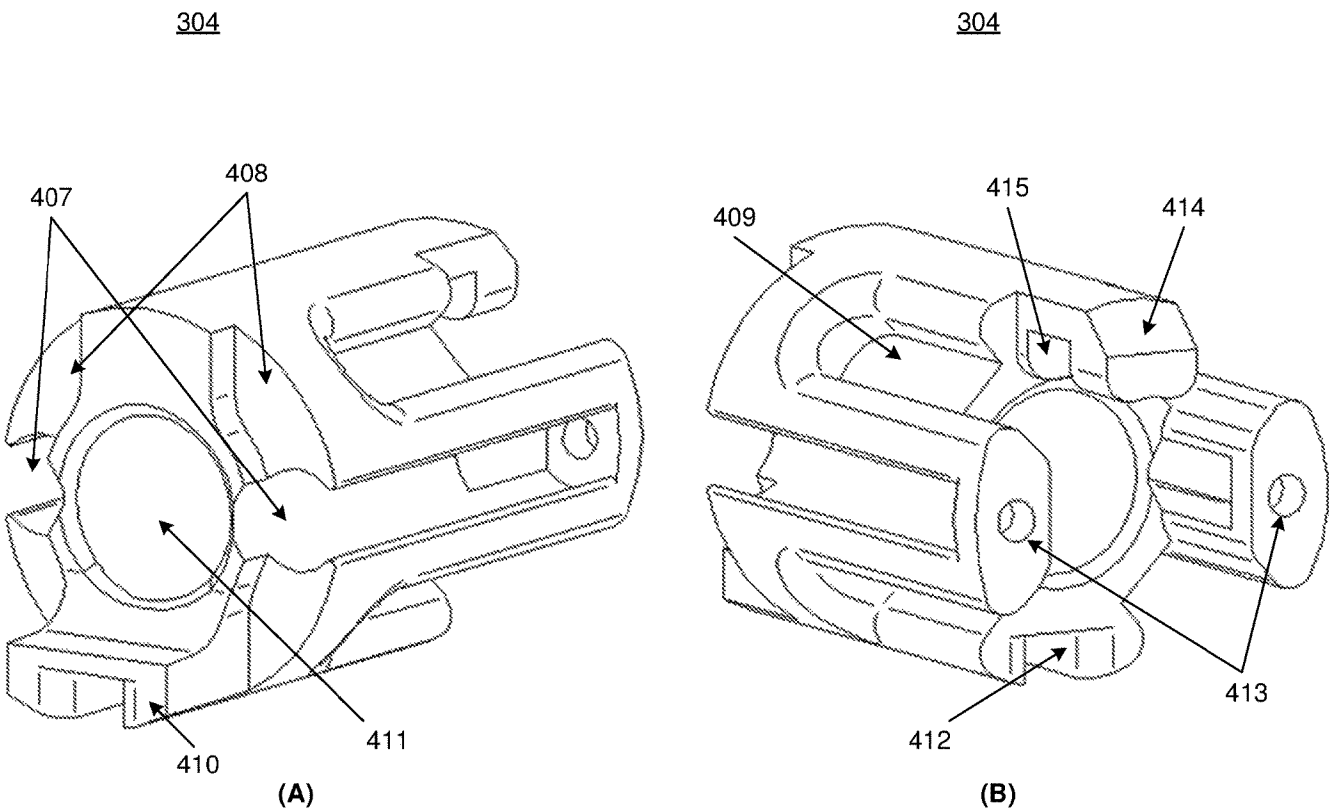
FIG. 4 is a diagram of a pusher/bolt carrier tail in accordance with an embodiment of the present disclosure.

FIG. 4 illustrates a buffer tail or bolt carrier tail 304 in accordance with an embodiment of the present disclosure. Bolt carrier tail 304 includes two cavity grooves 407. Each of the two cavity grooves 407 is configured to receive or otherwise accommodate the other distal end of a respective one of the two bolt carrier/main springs 303. Bolt carrier tail 304 also includes recess areas 408 configured to interact or otherwise come in contact with the rear end of bolt carrier head 301. Bolt carrier tail 304 is configured with four relief cuts 409 that make rooms for the structure of a newly designed buffer tube to be described below. Bolt carrier tail 304 further includes features such as a front lip surface 410, a clearance hole 411, a groove 412, two holes 413 which may be through holes or threaded holes, a hook 414, and a gap 415. Clearance hole 411 is configured to allow operation of a buffer spring guide rod. Groove 412 is similar to that on bolt carrier 103. The two holes 413 are configured to allow bolt carrier spring guide rods 302 to be connected to bolt carrier tail 304. That is, each of bolt carrier spring guide rods 302 may be threaded on one end to engage with a respective one of the holes 413. Alternatively, an end of the bolt carrier spring guide rods 302 may be bent after it is inserted to pass through the hole 403 as a through hole, such that front tip surface 410 of bolt carrier tail 304 may be in a position identical to a full-auto actuation surface on bolt carrier 103, while the other end of bolt carrier spring guide rods 302 may be bent so that it can be retained inside clearance groove 401.

Figure 5:
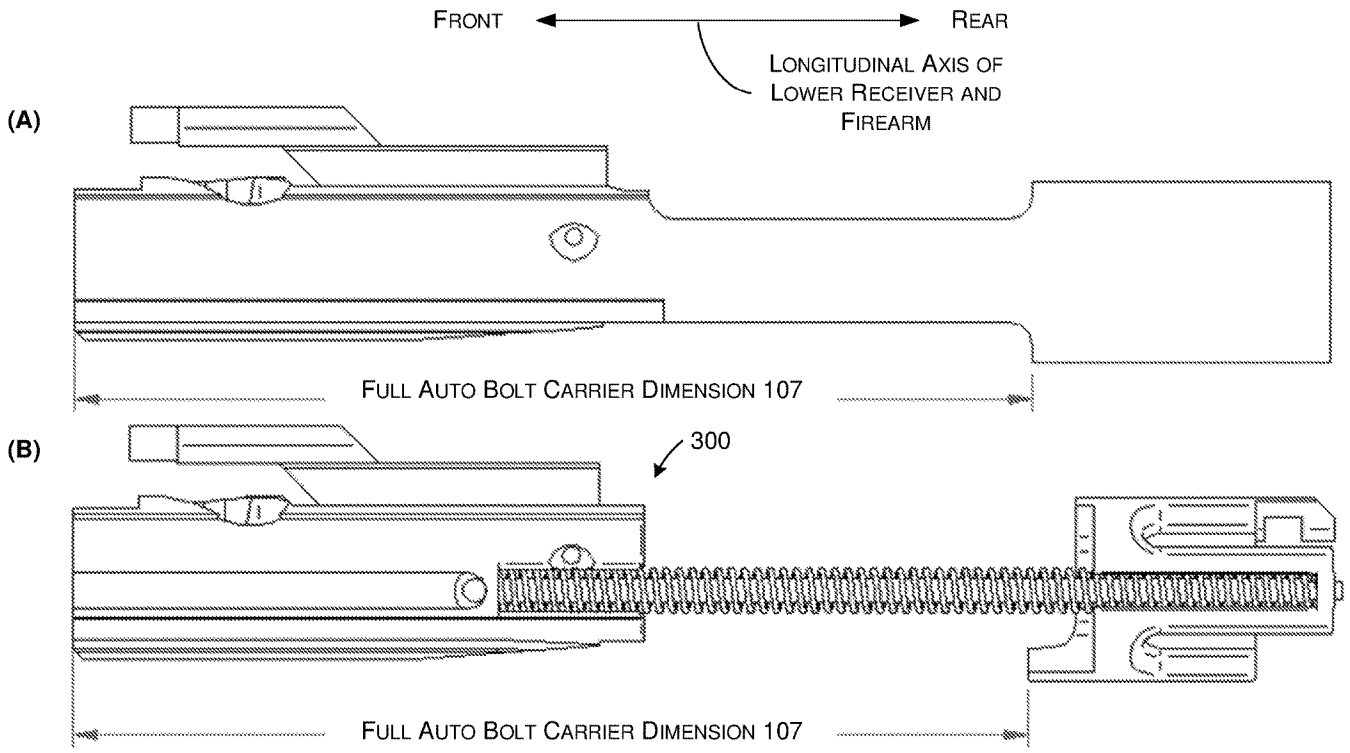
FIG. 5 is a diagram of a comparison between a conventional bolt carrier and a bolt carrier assembly in accordance with an embodiment of the present disclosure.

FIG. 5 illustrates a comparison between a conventional bolt carrier and a bolt carrier assembly in accordance with an embodiment of the present disclosure. Part (A) of FIG. 5 shows a conventional bolt carrier, and part (B) of FIG. 5 shows bolt carrier assembly 300. Referring to FIG. 5, bolt carrier assembly 300 is assembled in a way that front tip surface 410 would be at the same position as that of tail of bolt carrier 103 such that full-auto capability of bolt carrier 103 is retained in bolt carrier assembly 300.

Figure 6:
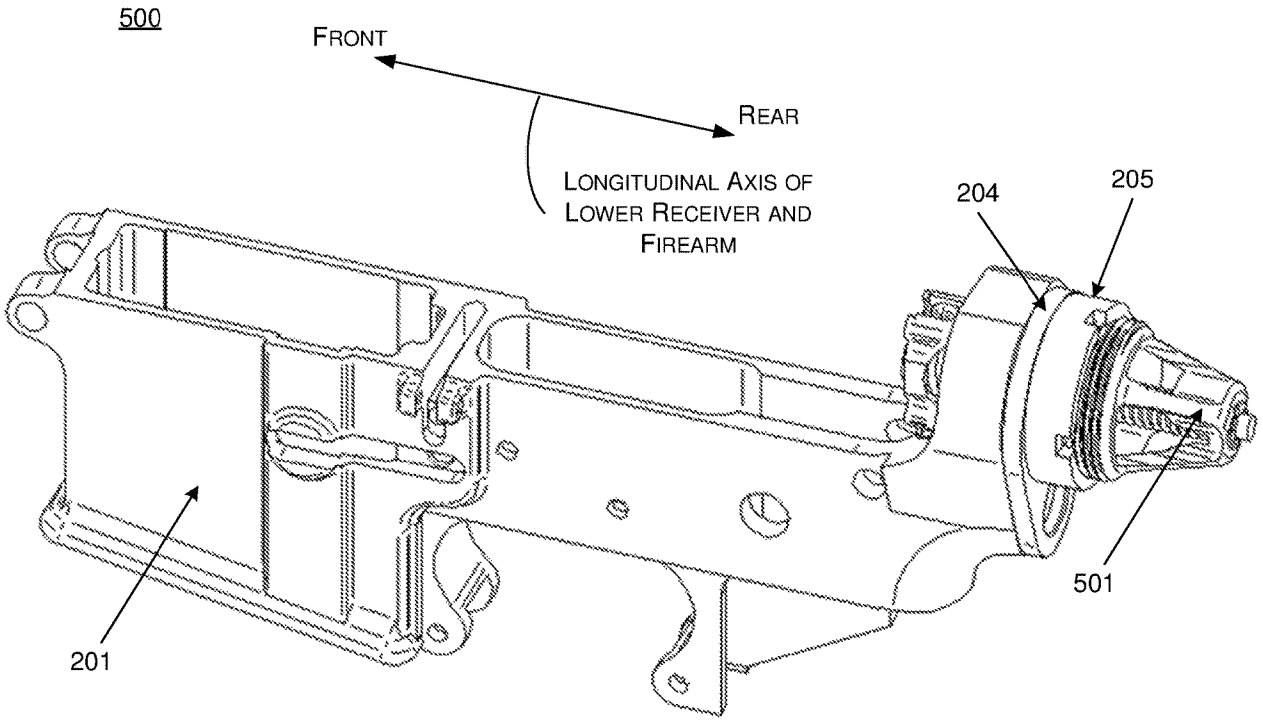
FIG. 6 is a diagram of a lower receiver with a shortened buffer tube and spring system in accordance with an embodiment of the present disclosure.

FIG. 6 illustrates lower receiver 201 with a shortened buffer tube and spring system 500 in accordance with an embodiment of the present disclosure. The buffer tube and spring system 500 is designed to provide bolt carrier assembly 300 an extra compression length (in addition to the main spring compression length) that is needed for bolt carrier head 301 to move to its furthest rearward position. Referring to FIG. 6, a buffer tube 501 of buffer tube and spring system 500 may be fastened to lower receiver 201 with end plate 204 and castle nut 205. In some implementations, buffer tube 501 may be fastened to lower receiver 201 with a folding stock adaptor (not shown) and a different kind of castle not (not shown).

Figure 7:
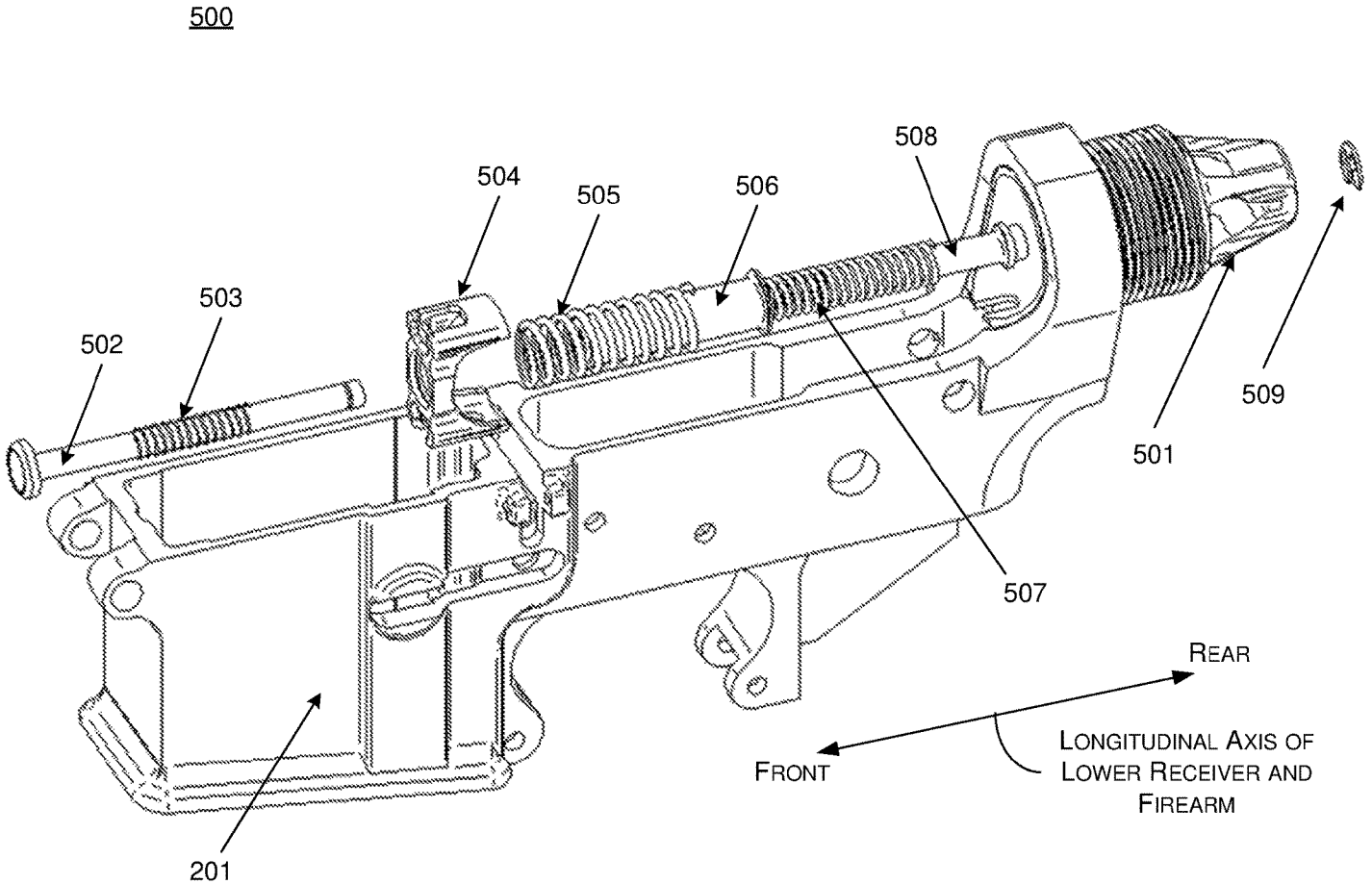
FIG. 7 is a diagram of an exploded view of a buffer tube and spring system mounted to a lower receiver in accordance with an embodiment of the present disclosure.

FIG. 7 illustrates an exploded view of buffer tube and spring system 500 mounted to lower receiver in accordance with an embodiment of the present disclosure. Buffer tube and spring system 500 is designed to provide bolt carrier assembly 300 with necessary retraction space when bolt carrier assembly 300 is compressed during operation. Buffer tube and spring system 500 includes an inner sliding guide rod 502, a guide rod spring 503, a pusher 504, an outer spring 505, an outer spring/inner spring coupler 506, an inner spring 507, a fixed inner guide rod 508, and a retainer clamp spring 509 configured to be coupled to inner sliding guide rod 502. Hook 414 of bolt carrier tail 304 may connect with pusher 504. The two inner walls of gap 415 may be in contact with pusher 504 during different stages of operation of bolt carrier assembly 300 as it moves inside an upper receiver (not shown) of the firearm.

Figure 8:
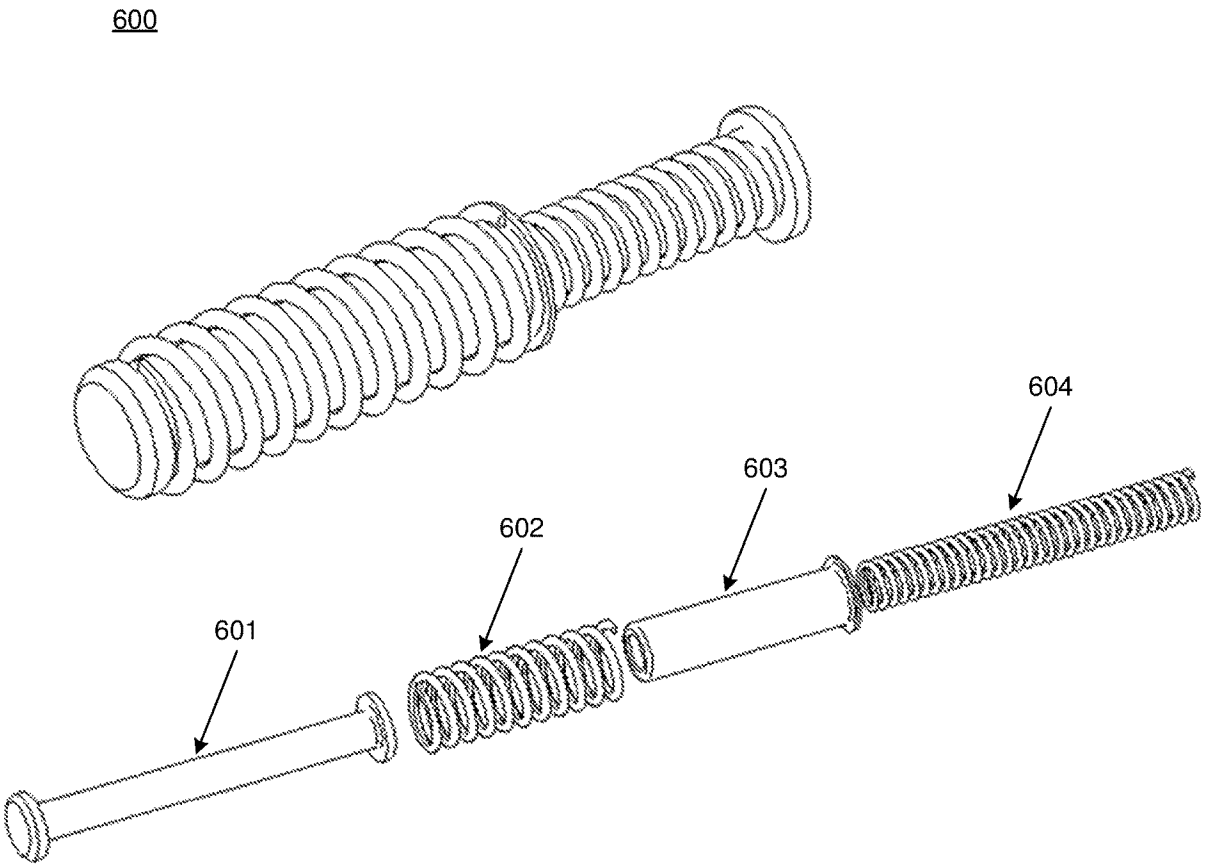
FIG. 8 (PRIOR ART)
FIG. 8 is a diagram of an exploded view of a conventional spring assembly of a pistol.

FIG. 8 illustrates an exploded view of a conventional spring assembly 600 of a pistol. Buffer tube and spring system 500 may be, in some way, similar to spring assembly 600, which includes an inner guide rod 601, an outer spring 602, an inner spring/outer spring coupler 603, and an inner spring 604. One main difference between buffer tube and spring system 500 and spring assembly 600 may be that, buffer tube and spring system 500, the inner guide rod 601 is replaced with a three-part assembly including inner sliding guide rod 502, guide rod spring 503 and fixed inner guide rod 508. This design is to provide space for retraction of bolt carrier assembly 300. In comparison, the design of spring assembly 600 would interfere with bolt carrier assembly 300.

Figure 9:
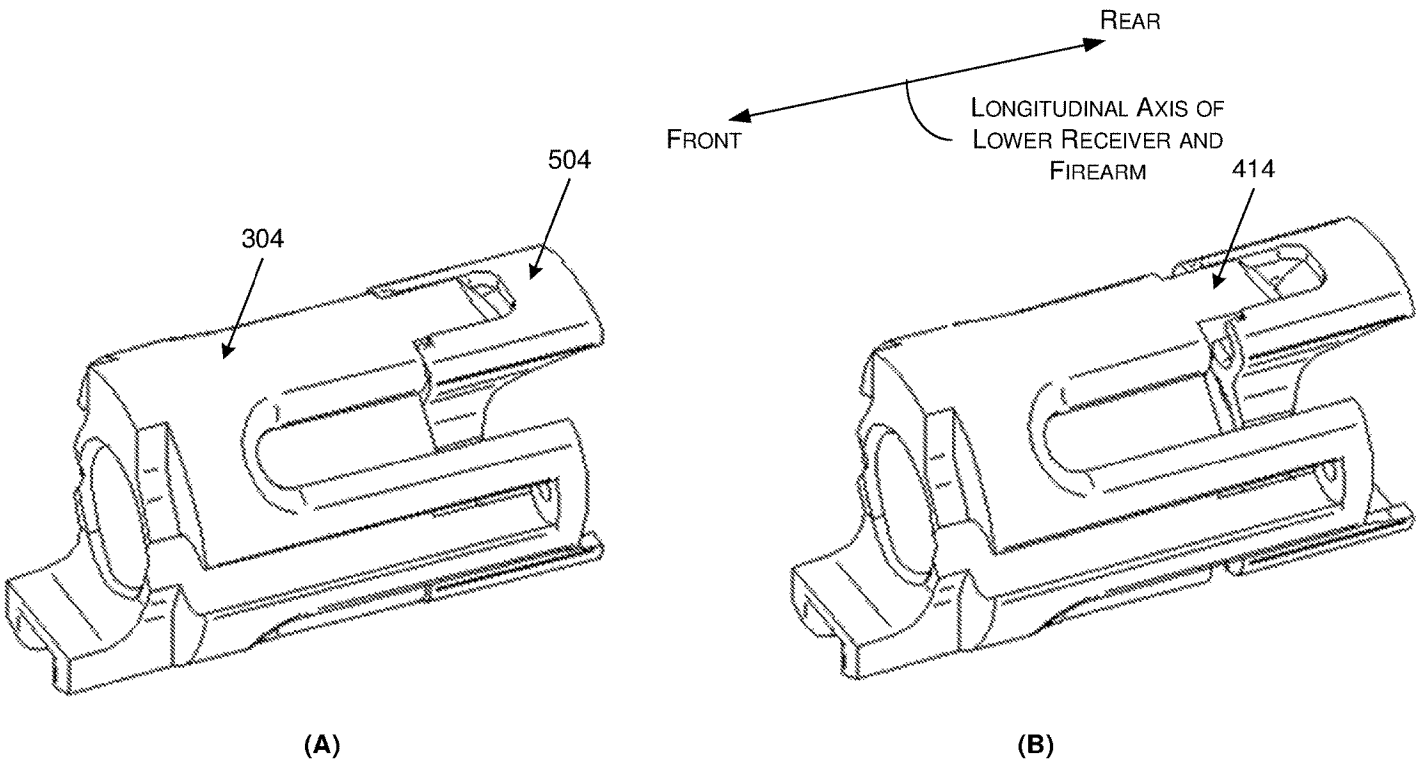
FIG. 9 is a diagram showing a relationship between a bolt carrier tail and a pusher in accordance with an embodiment of the present disclosure.

FIG. 9 illustrates a relationship between bolt carrier tail 304 and a pusher 504 in accordance with an embodiment of the present disclosure. Pusher 504 is designed to engage with outer spring 505, the head of inner spring guide rod 502, and bolt carrier tail 304. When traveling together with bolt carrier tail 304, pusher 504 may constantly come in contact with outer spring 505. When the upper receiver is open from the lower receiver 201, pusher 504 may be retained by inner spring guide rod 502 under the pressure from outer spring 505. When the upper receiver is closed to lower receiver 201, pusher 504 may come in contact with bolt carrier tail 304 in two different positions as shown in FIG. 9. Part (A) of FIG. 9 shows the rear side of bolt carrier tail 304 being in contact with pusher 504, and this is the usual relationship between bolt carrier tail 304 and pusher 504. Part (B) of FIG. 9 shows bolt carrier tail 304 moved forward to its most frontward position under its own forward moving momentum when the bolt carrier head 301 impact to the end of barrel extension (not shown). In BCG 100, bolt carrier 103 tends to bounce back a little when impact onto the end of barrel extension (not shown), causing a "bolt bounce" problem which may affect the full-auto function of the firearm. This problem is alleviated with the introduction of buffer 202, which can include several heavy metallic discs or cylinders (not shown) that add weight/impact to bolt carrier and hit the buffer 202, hence transfer the force to the bolt carrier 103, under its momentum when bolt carrier 103 is stopped by the barrel extension (not shown), before bolt carrier 103 bounces back from the barrel extension.

In buffer tube and spring system 500, however, there is no room for buffer 202. Dur to the connection of bolt carrier/main spring 303 and the comprehensive buffer spring behind it, when bolt carrier head 301 impacts on the barrel extension, bolt carrier tail 304 may continue traveling forward under its own momentum. The momentum and force would transfer to bolt carrier head 301 through bolt carrier/main spring 303, which would function as a buffer. Hook 414 may limit the travel distance of bolt carrier tail 304 (e.g., limited by pusher 504) to avoid resonance with bolt carrier head 301.

Figure 10:
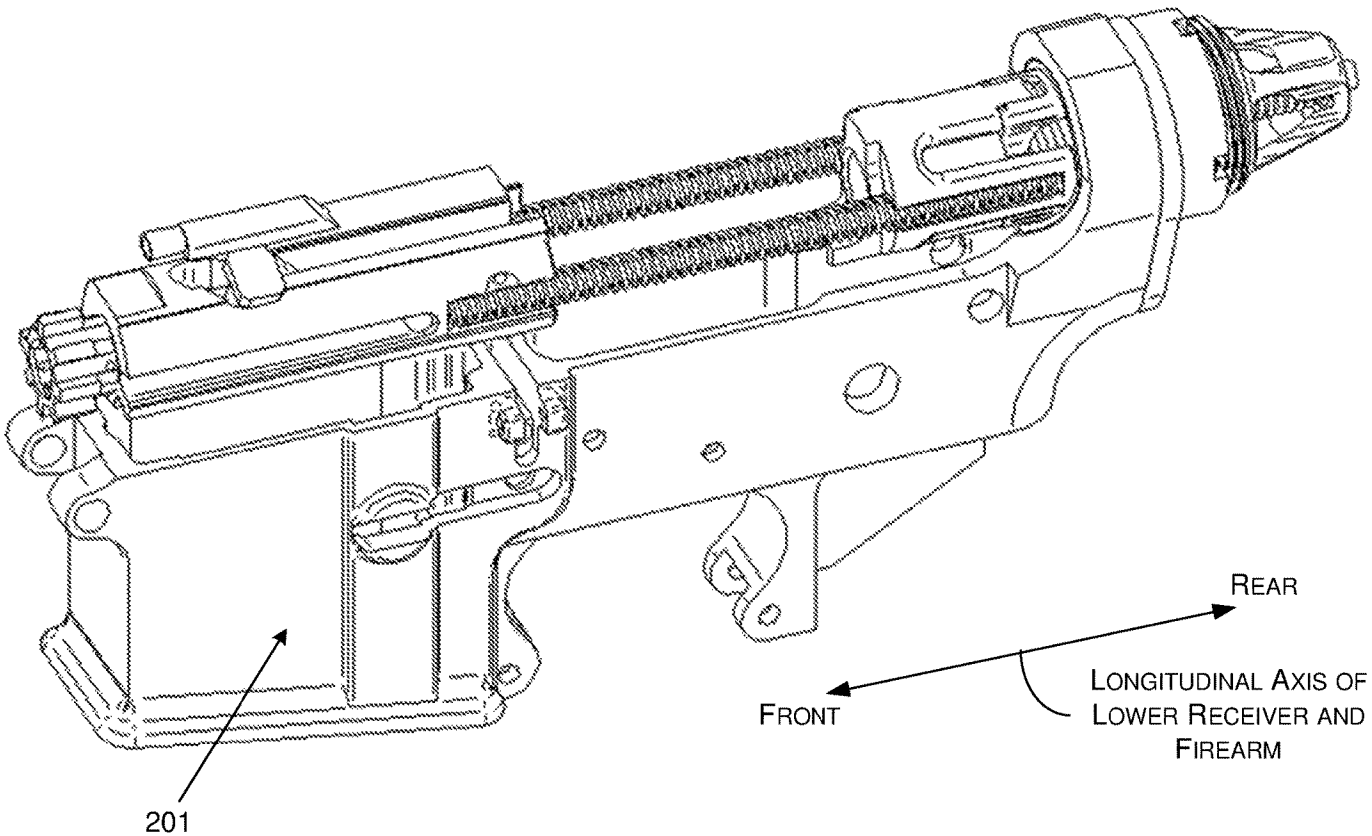
FIG. 10 is a diagram of a BCG assembly with a main spring fully extended in accordance with an embodiment of the present disclosure.
Figure 11:
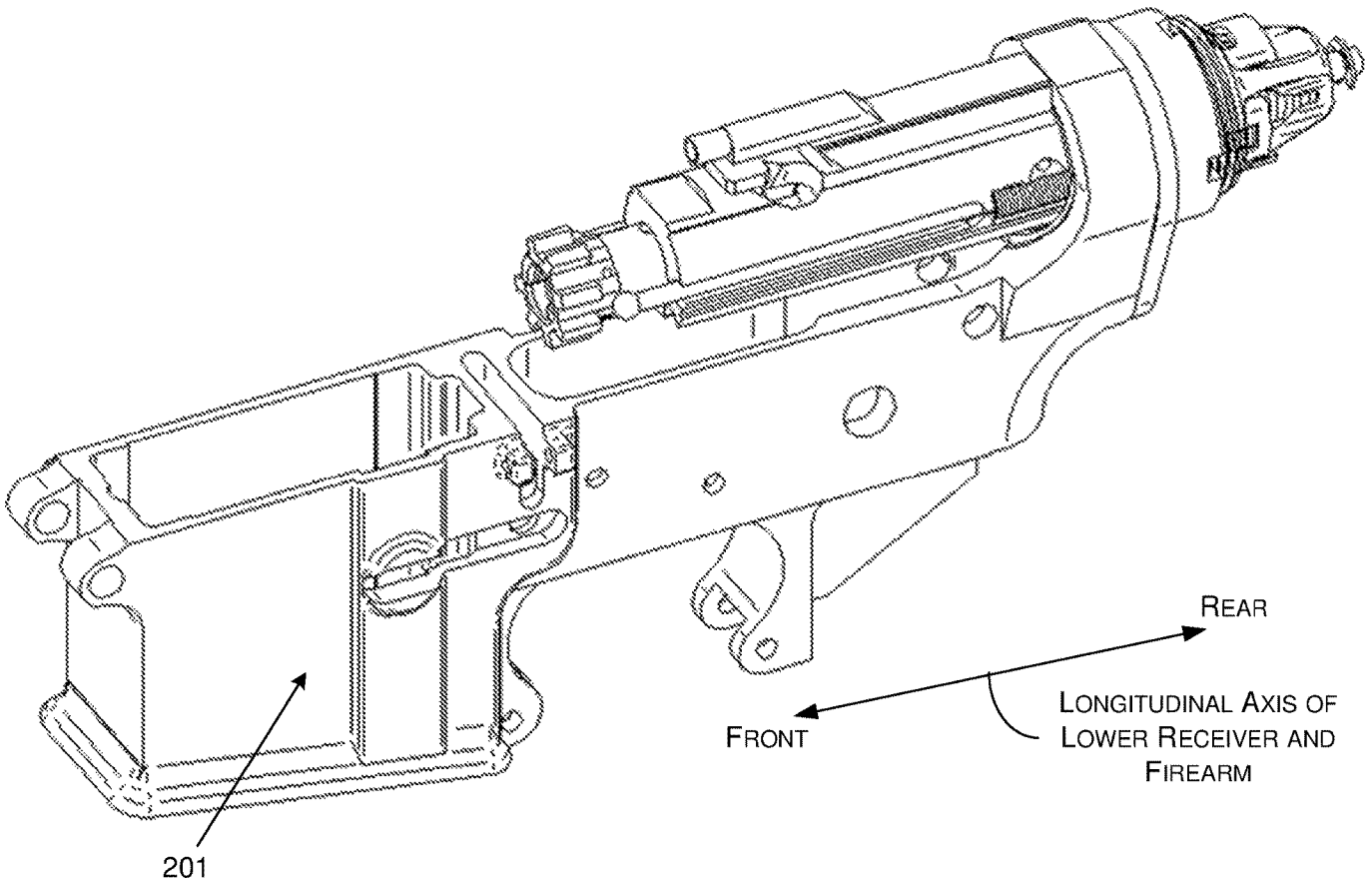
FIG. 11 is a diagram of a BCG assembly with a main spring fully compressed in accordance with an embodiment of the present disclosure.

FIG. 10 illustrates a BCG assembly with a main spring fully extended with respect to lower receiver 102 in accordance with an embodiment of the present disclosure. FIG. 11 illustrates a BCG assembly with a main spring fully compressed with respect to lower receiver 102 in accordance with an embodiment of the present disclosure. With this design, an extremely short buffer tube together with the new BCG design would allow normal operation (including full-auto capability) and disassembly of the firearm.

Figure 12:
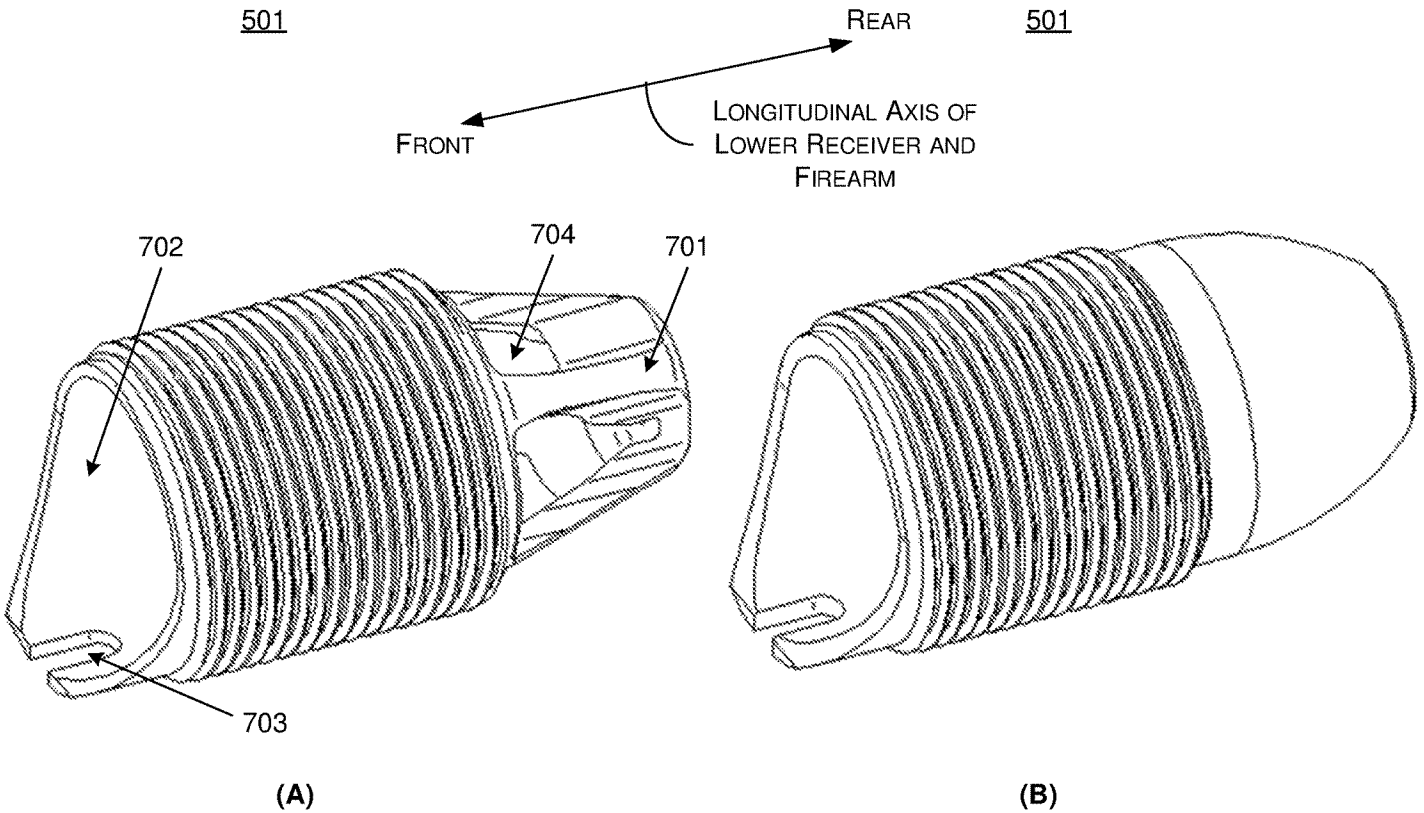
FIG. 12 is a diagram of a buffer tube design in accordance with an embodiment of the present disclosure.

FIG. 12 illustrates a design of buffer tube 501 in accordance with an embodiment of the present disclosure. Part (A) of FIG. 12 shows that buffer tube 501 includes four ribs 701 that support a rear flange, which leaves four clearance holes 704. Buffer tube 501 also includes a buffer tube main shaft 702 that allows bolt carrier tail 304 to retract and be received therein. Buffer tube 501 further includes a clearance groove 703 that gives way to a buffer retaining pin (not shown) on lower receiver 102. Clearance groove 703 also serves as an indexing key for buffer tube 501 to align correctly with lower receiver 102 before buffer tube 501 is tightened to position by castle nut 205. Buffer tube 501 may be designed to be sealed on one end as shown in part (B) of FIG. 12, although the length of buffer tube 501 would be slightly longer to accommodate pusher 504 and bolt carrier tail 304 therein without contamination of foreign objects.

In view of the above, it is believed that those with ordinary skill in the art would appreciate a number of design features presented herein. For instance, the clearance grooves for bolt carrier springs are located behind the pressure chamber inside the bolt carrier head for safety reasons. Moreover, the spring guide rod clearance grooves on the bolt carrier do not weaken the pressure chamber more than that of the magazine clearance groove. This is an important feature as there are other prior designs that would allow the spring groove to pass through the pressure chamber, which would weaken the structure more than the proposed design of the present disclosure. Additionally, the design of bolt carrier tail retains the full-auto capability while functioning as a buffer. The pusher provides a vertical support to prevent the buffer tube inner spring guide rod from bending during assembly and disassembly of the firearm. The pusher also provides a limit on axial movement for the bolt carrier tail to prevent resonance with the bolt carrier head. Furthermore, the design of ribs on the buffer tube would shorten the operation length of the system. The sliding inner spring guide rod and its fixed base are designed to make rooms for the firing pin and its housing on the bolt carrier head during retraction and compression of the bolt carrier assembly. Moreover, the design of the bolt carrier tail allows a portion of the main spring to overlap with the buffer spring system to further shorten the overall length of the bolt carrier assembly proposed herein.

Highlights of Select Features

In one aspect, a device implementable in an AR-15 styled firearm may include a buffer tube and spring system and a bolt carrier assembly. The buffer tube and spring system may be configured to be mounted on a rear end of a lower receiver of the firearm. The buffer tube and spring system may include a pusher and a buffer tube. The buffer tube may include a cavity configured to receive the bolt tail and the pusher therein. The bolt carrier assembly may include a bolt carrier head and a bolt carrier tail. A rear end of the bolt carrier tail may be connected to the pusher. A front end of the bolt carrier head may include a cavity configured to house a bolt assembly of the firearm therein. A front end of the bolt carrier tail may be elastically coupled to a rear end of the bolt carrier head such that, during operation of the firearm: (1) the bolt carrier head travels linearly at most by a first dimension, (2) the bolt carrier tail travels linearly at most by a second dimension smaller than the first dimension, and (3) the pusher travels linearly at most by a third dimension smaller than the second dimension.

In some implementations, the bolt carrier assembly may further include a bolt carrier spring guide rod and a bolt carrier spring around the bolt carrier spring guide rod. At least one side of the bolt carrier head may include a first clearance groove, a second clearance groove and a guide rod clearance hole between the first clearance groove and the second clearance groove such that a first distal end of the bolt carrier spring guide rod traverses through the guide rod clearance hole to be slidingly received in the first clearance groove and the second clearance groove. At least one side of the bolt carrier tail may include a cavity groove and a hole such that a second distal end of the bolt carrier spring guide rod opposite the first distal end thereof is connected to the bolt carrier tail through threads or by bending a tip of the second distal end of the bolt carrier spring guide rod. The bolt carrier spring may be slidingly received in the second clearance groove of the bolt carrier head and the cavity groove of the bolt carrier tail.

In some implementations, a surface of the guide rod clearance hole facing the bolt carrier spring may be on a same plane as a surface of a pressure chamber within the bolt carrier head that is subject to an internal pressure from explosion of a round of ammunition during operation of the firearm.

In some implementations, the buffer tube and spring system may further include: an outer spring/inner spring coupler, an outer spring around the outer spring/inner spring coupler, a fixed inner guide rod coupled to the outer spring/inner spring coupler, an inner spring around the fixed inner guide rod, an inner sliding guide rod slidingly received in a hollow of the fixed inner guide rod, a guide rod spring around the inner sliding guide rod, and a retainer clamp spring configured to be couple a distal end of the inner sliding guide rod to the buffer tube.

In some implementations, the pusher may provide vertical support to the inner spring guide rod such that bending of the inner spring guide rod is prevented during assembly and disassembly of the firearm.

In some implementations, at least a portion of the bolt carrier spring may overlap with the buffer tube and spring system along a longitudinal axis of the lower receiver.

In some implementations, the pusher may limit a linear movement of the bolt carrier tail along a longitudinal axis of the lower receiver such that a resonance between the bolt carrier tail and the bolt carrier head during operation of the firearm is dampened.

In some implementations, the buffer tube may include a plurality of ribs.

In some implementations, the bolt carrier head may include a magazine relief cut area. A wall thickness between the first clearance groove and the cavity at the front end of the bolt carrier head may be greater than a wall thickness between the magazine relief cut area and the cavity at the front end of the bolt carrier head.

In some implementations, the wall thickness between the first clearance groove and the cavity at the front end of the bolt carrier head may be greater than the wall thickness between the magazine relief cut area and the cavity at the front end of the bolt carrier head by at least 0.014 inch.

In another aspect, an AR-15 styled firearm may include a lower receiver, a bolt assembly, a buffer tube and spring system and a bolt carrier assembly. The buffer tube and spring system may be mounted on a rear end of the lower receiver. The buffer tube and spring system may include a pusher and a buffer tube. The buffer tube may include a cavity configured to receive the bolt carrier tail and the pusher therein. The bolt carrier assembly may include a bolt carrier head and a bolt carrier tail. A rear end of the bolt carrier tail may be connected to the pusher. A front end of the bolt carrier head may include a cavity configured to house the bolt assembly therein. A front end of the bolt carrier tail may be elastically coupled to a rear end of the bolt carrier head such that, during operation of the firearm: (1) the bolt carrier head travels linearly at most by a first dimension, (2) the bolt carrier tail travels linearly at most by a second dimension smaller than the first dimension, and (3) the pusher travels linearly at most by a third dimension smaller than the second dimension.

In some implementations, the bolt carrier assembly may further include a bolt carrier spring guide rod and a bolt carrier spring around the bolt carrier spring guide rod. At least one side of the bolt carrier head may include a first clearance groove, a second clearance groove and a guide rod clearance hole between the first clearance groove and the second clearance groove such that a first distal end of the bolt carrier spring guide rod traverses through the guide rod clearance hole to be slidingly received in the first clearance groove and the second clearance groove. At least one side of the bolt carrier tail may include a cavity groove and a hole such that a second distal end of the bolt carrier spring guide rod opposite the first distal end thereof is connected to the bolt carrier tail through threads or by bending a tip of the second distal end of the bolt carrier spring guide rod. The bolt carrier spring may be slidingly received in the second clearance groove of the bolt carrier head and the cavity groove of the bolt carrier tail.

In some implementations, a surface of the guide rod clearance hole facing the bolt carrier spring may be on a same plane as a surface of a pressure chamber within the bolt carrier head that is subject to an internal pressure from explosion of a round of ammunition during operation of the firearm.

In some implementations, the buffer tube and spring system may further include: an outer spring/inner spring coupler, an outer spring around the outer spring/inner spring coupler, an fixed inner guide rod coupled to the outer spring/inner spring coupler, an inner spring around the fixed inner guide rod, an inner sliding guide rod slidingly received in a hollow of the fixed inner guide rod, a guide rod spring around the inner sliding guide rod, and a retainer clamp spring configured to be couple a distal end of the inner sliding guide rod to the buffer tube.

In some implementations, the pusher may provide vertical support to the inner spring guide rod such that bending of the inner spring guide rod is prevented during assembly and disassembly of the firearm.

In some implementations, at least a portion of the bolt carrier spring may overlap with the buffer tube and spring system along a longitudinal axis of the lower receiver.

In some implementations, the pusher may limit a linear movement of the bolt carrier tail along a longitudinal axis of the lower receiver such that a resonance between the bolt carrier tail and the bolt carrier head during operation of the firearm is dampened.

In some implementations, the buffer tube may include a plurality of ribs.

In some implementations, the bolt carrier head may include a magazine relief cut area. A wall thickness between the first clearance groove and the cavity at the front end of the bolt carrier head may be greater than a wall thickness between the magazine relief cut area and the cavity at the front end of the bolt carrier head.

In some implementations, the wall thickness between the first clearance groove and the cavity at the front end of the bolt carrier head may be greater than the wall thickness between the magazine relief cut area and the cavity at the front end of the bolt carrier head by at least 0.014 inch.

In some implementations, the firearm may further include a foldable stock attached to the rear end of the lower receiver. When the foldable stock is folded to one side of the lower receiver, the bolt carrier assembly and the buffer tube and spring system may allow the firearm to operate by firing one or more rounds of ammunition.

Additional Notes

It will be apparent to those skilled in the art that various modifications and variations can be made to the structure of the present disclosure without departing from the above-described embodiments or spirit of the present disclosure. Moreover, although examples given in the present disclosure are directed to firearms and usage of the embodiments for firearms, there is no limit on the applications of embodiments of the embodiments disclosed herein. That is, any suitable implementation or application using an embodiment of the present disclosure, or variation thereof, is still within the scope of the present disclosure. In view of the foregoing, it is intended that the present disclosure cover modifications and variations of the present disclosure in view of the scope of the following claims and their equivalents.

What is claimed is:

1. A device implementable in a firearm, comprising:

a buffer tube and spring system configured to be mounted on a rear end of a lower receiver of the firearm, the buffer tube and spring system comprising a pusher and a buffer tube; and a bolt carrier assembly comprising a bolt carrier head and a bolt carrier tail, wherein a rear end of the bolt carrier tail is connected to the pusher, wherein the buffer tube comprises a cavity configured to receive the bolt carrier tail and the pusher therein, wherein a front end of the bolt carrier head comprises a cavity configured to house a bolt assembly of the firearm therein, and wherein a front end of the bolt carrier tail is elastically coupled to a rear end of the bolt carrier head such that, during operation of the firearm:

the bolt carrier head travels linearly at most by a first dimension, the bolt carrier tail travels linearly at most by a second dimension smaller than the first dimension, and the pusher travels linearly at most by a third dimension smaller than the second dimension.

2. The device of claim 1, wherein the bolt carrier assembly further comprises:

a bolt carrier spring guide rod; and a bolt carrier spring around the bolt carrier spring guide rod, wherein at least one side of the bolt carrier head comprises a first clearance groove, a second clearance groove and a guide rod clearance hole between the first clearance groove and the second clearance groove such that a first distal end of the bolt carrier spring guide rod traverses through the guide rod clearance hole to be slidingly received in the first clearance groove and the second clearance groove, wherein at least one side of the bolt carrier tail comprises a cavity groove and a hole such that a second distal end of the bolt carrier spring guide rod opposite the firs distal end thereof is connected to the bolt carrier tail through threads or by bending a tip of the second end of the bolt carrier spring guide rod, and wherein the bolt carrier spring is slidingly received in the second clearance groove of the bolt carrier head and the cavity groove of the bolt carrier tail.

3. The device of claim 2, wherein a surface of the guide rod clearance hole facing the bolt carrier spring is on a same plane as a surface of a pressure chamber within the bolt carrier head that is subject to an internal pressure from explosion of a round of ammunition during operation of the firearm.

4. The device of claim 2, wherein the buffer tube and spring system further comprises:

an outer spring/inner spring coupler;

an outer spring around the outer spring/inner spring coupler;

a fixed inner guide rod coupled to the outer spring/inner spring coupler;

an inner spring around the fixed inner guide rod;

an inner sliding guide rod slidingly received in a hollow of the fixed inner guide rod;

a guide rod spring around the inner sliding guide rod; and a retainer clamp spring configured to be couple a distal end of the inner sliding guide rod to the buffer tube.

5. The device of claim 4, wherein the pusher provides vertical support to the inner spring guide rod such that bending of the inner spring guide rod is prevented during assembly and disassembly of the firearm.

6. The device of claim 4, wherein at least a portion of the bolt carrier spring overlaps with the buffer tube and spring system along a longitudinal axis of the lower receiver.

7. The device of claim 1, wherein the pusher limits a linear movement of the bolt carrier tail along a longitudinal axis of the lower receiver such that a resonance between the bolt carrier tail and the bolt carrier head during operation of the firearm is dampened.

8. The device of claim 1, wherein the buffer tube comprises a plurality of ribs.

9. The device of claim 1, wherein the bolt carrier head comprises a magazine relief cut area, wherein a wall thickness between the first clearance groove and the cavity at the front end of the bolt carrier head is greater than a wall thickness between the magazine relief cut area and the cavity at the front end of the bolt carrier head.

10. The device of claim 9, wherein the wall thickness between the first clearance groove and the cavity at the front end of the bolt carrier head is greater than the wall thickness between the magazine relief cut area and the cavity at the front end of the bolt carrier head by at least 0.014 inch.

11. A firearm, comprising:

a lower receiver;

a bolt assembly;

a buffer tube and spring system mounted on a rear end of the lower receiver, the buffer tube and spring system comprising a pusher and a buffer tube; and a bolt carrier assembly comprising a bolt carrier head and a bolt carrier tail, wherein a rear end of the bolt carrier tail is connected to the pusher, wherein the buffer tube comprises a cavity configured to receive the bolt carrier tail and the pusher therein, wherein a front end of the bolt carrier head comprises a cavity configured to house the bolt assembly therein, and wherein a front end of the bolt carrier tail is elastically coupled to a rear end of the bolt carrier head such that, during operation of the firearm:

the bolt carrier head travels linearly at most by a first dimension, the bolt carrier tail travels linearly at most by a second dimension smaller than the first dimension, and the pusher travels linearly at most by a third dimension smaller than the second dimension.

12. The firearm of claim 11, wherein the bolt carrier assembly further comprises:

a bolt carrier spring guide rod; and a bolt carrier spring around the bolt carrier spring guide rod, wherein at least one side of the bolt carrier head comprises a first clearance groove, a second clearance groove and a guide rod clearance hole between the first clearance groove and the second clearance groove such that a first distal end of the bolt carrier spring guide rod traverses through the guide rod clearance hole to be slidingly received in the first clearance groove and the second clearance groove, wherein at least one side of the bolt carrier tail comprises a cavity groove and a hole such that a second distal end of the bolt carrier spring guide rod opposite the firs distal end thereof is connected to the bolt carrier tail through threads or by bending a tip of the second end of the bolt carrier spring guide rod, and wherein the bolt carrier spring is slidingly received in the second clearance groove of the bolt carrier head and the cavity groove of the bolt carrier tail.

13. The firearm of claim 12, wherein a surface of the guide rod clearance hole facing the bolt carrier spring is on a same plane as a surface of a pressure chamber within the bolt carrier head that is subject to an internal pressure from explosion of a round of ammunition during operation of the firearm.

14. The firearm of claim 12, wherein the buffer tube and spring system further comprises:

an outer spring/inner spring coupler;

an outer spring around the outer spring/inner spring coupler;

a fixed inner guide rod coupled to the outer spring/inner spring coupler;

an inner spring around the fixed inner guide rod;

an inner sliding guide rod slidingly received in a hollow of the fixed inner guide rod;

a guide rod spring around the inner sliding guide rod; and a retainer clamp spring configured to be couple a distal end of the inner sliding guide rod to the buffer tube.

15. The firearm of claim 14, wherein the pusher provides vertical support to the inner spring guide rod such that bending of the inner spring guide rod is prevented during assembly and disassembly of the firearm.

16. The firearm of claim 14, wherein at least a portion of the bolt carrier spring overlaps with the buffer tube and spring system along a longitudinal axis of the lower receiver.

17. The firearm of claim 11, wherein the pusher limits a linear movement of the bolt carrier tail along a longitudinal axis of the lower receiver such that a resonance between the bolt carrier tail and the bolt carrier head during operation of the firearm is dampened.

18. The firearm of claim 11, wherein the buffer tube comprises a plurality of ribs.

19. The firearm of claim 11, wherein the bolt carrier head comprises a magazine relief cut area, wherein a wall thickness between the first clearance groove and the cavity at the front end of the bolt carrier head is greater than a wall thickness between the magazine relief cut area and the cavity at the front end of the bolt carrier head.

20. The firearm of claim 11, further comprising:

a foldable stock attached to the rear end of the lower receiver, wherein, when the foldable stock is folded to one side of the lower receiver, the bolt carrier assembly and the buffer tube and spring system allow the firearm to operate by firing one or more rounds of ammunition.

* * * * *